United States Patent [19]

Vitanov et al.

[11] 3,987,844

[45] Oct. 26, 1976

[54] PRESSURE CASTING APPARATUS WITH HERMETICALLY SEALED HOUSING AND TILTABLE MELT-CONTAINING CRUCIBLE

[75] Inventors: Yordan Ivanov Vitanov; Boris Petrov Yordanov; Kalcho Minkov Mihovski; Boris Yordanov Drakaliski, all of Sofia, Bulgaria

[73] Assignee: DSO "Metalurgia i Rudodobiv", Sofia, Bulgaria

[22] Filed: Mar. 13, 1975

[21] Appl. No.: 558,069

Related U.S. Application Data

[62] Division of Ser. No. 469,305, May 13, 1974, abandoned.

[52] U.S. Cl. ..... 164/256; 164/62

[51] Int. Cl.[2] ..... B22D 27/14; B22D 27/16

[58] Field of Search ..... 164/61, 65, 256, 258, 164/62, 259, 335, 350

[56] References Cited

UNITED STATES PATENTS

| | | | |
|---|---|---|---|
| 493,047 | 3/1893 | Simpson | 164/256 |
| 2,564,498 | 8/1951 | Nisbet | 164/61 X |
| 2,713,183 | 7/1955 | Winkler | 164/258 |
| 3,470,936 | 10/1969 | Jandras | 164/61 |
| 3,690,367 | 9/1972 | Daniels | 164/258 X |

FOREIGN PATENTS OR APPLICATIONS

| | | | |
|---|---|---|---|
| 502,266 | 11/1954 | Italy | 164/254 |

*Primary Examiner*—Robert D. Baldwin
*Attorney, Agent, or Firm*—Karl F. Ross; Herbert Dubno

[57] ABSTRACT

A metal casting apparatus comprising an upright pressurizable housing open at its bottom adapted to receive an upright upwardly open container with a casting mold in a lower part of the container. A molten-metal receptacle is mounted in the container above the mold and undergoes tilting movement about a horizontal axis whereby the receptacle dispenses metal into the casting passage in a tilted position of the receptacle and receives molten metal in an upright position of the receptacle. Means is provided for hermetically sealing the bottom of the housing upon the insertion of the container therein with the receptacle in its upright position, while valve means is connected to the housing for evacuating and pressurizing it.

5 Claims, 1 Drawing Figure

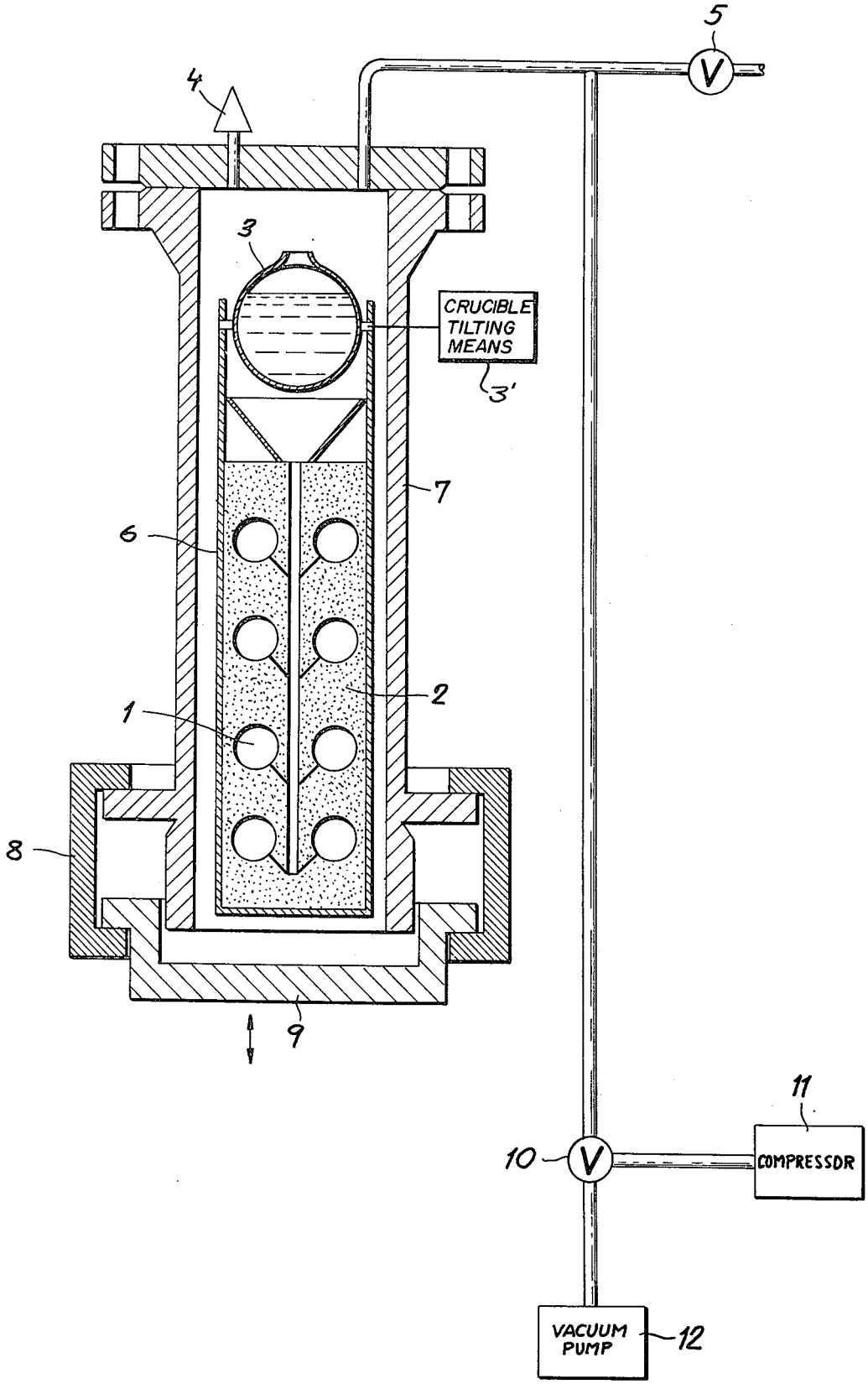
5
V
4
3
CRUCIBLE TILTING MEANS
3'
7
6
2
1
8
9
11
10
V
COMPRESSOR
VACUUM PUMP
12

PRESSURE CASTING APPARATUS WITH HERMETICALLY SEALED HOUSING AND TILTABLE MELT-CONTAINING CRUCIBLE

CROSS-REFERENCE TO RELATED APPLICATION

This application is a division of our copending application Ser. No. 469,305 filed May 13, 1974, now abandoned and replaced by Ser. No. 654,574.

FIELD OF THE INVENTION

This invention relates to an apparatus for casting metals and metal alloys, particularly for making castings having a high density and a crystal structure without microbubbles.

BACKGROUND OF THE INVENTION

A method and an apparatus for casting under pressure, using a counterpressure in the mold, are known. Their drawback is the possibility that previous metallurgical processes may be disturbed. This drawback can be eliminated only by prolonging the duration of the casting step, leading to a reduction of productivity. This process is characterized by widely variable pressure conditions of the casting formed by the feeding tube and the mold, which is filled initially with gas at atmospheric pressure; then the pressure is increased to its operating value; the volume is filled with molten metal; the gas is discharged through the venting channels of the mold; and at the end of the process, the pressure is relieved. This volume (casting space) is enclosed between walls which, during the casting process come into contact first with gas and then with the moving level of the melt. The venting channels of the mold have a small size which does not let through molten metal, but only gas with a high degree of throttling. The design of the apparatus has the disadvantage that when gas of the same pressure is applied to the mold chamber and to the reservoir chamber for the molten metal, because of the throttling in the venting channels, the increase of the pressure in the casting space is delayed and molten metal enters it prematurely. If the pressure in the reservoir chamber is maintained to avoid random motion of the melt, there is a danger that gas may enter this reservoir from the mold through the feeding tube.

An improved apparatus for casting under gas pressure using gas counterpressure is known, in which these drawbacks are avoided by providing a controllable connection between the casting space, formed by the mold together with the feeding tube, and the reservoir chamber. This connection is effected by means of a closeable opening (aperture), located on the wall of the casting space. It is a drawback of this system that in the processing of highmelting metals at temperatures over 1000° C, the passage of the metal through a syphon-type feeder tube and its closing between both chambers for multiple casting is impossible.

It is another drawback of this method that, because of the initially produced pressure, the gases from the melt cannot be readily separated (released) during the casting process.

The aforementioned method, as well as other known methods and apparatuses for casting under pressure or with counterpressure are used for aluminum and aluminum alloys, while application of similar techniques for high-melting metals with a melting temperature higher than 1000° C is difficult.

Also known is a method for injection casting, in which the transfer of the molten metal into the mold is carried out under the action of pressure. This casting method has been applied successfully mainly for non-ferrous metals and for castings of high weight and simple shape.

OBJECT OF THE INVENTION

It is therefore an object of the present invention to avoid all aforementioned drawbacks of the known methods and apparatuses for casting under gas pressure in order to accelerate the process and to obtain castings with increased strength properties and an improved crystal structure without any microporosity.

SUMMARY OF THE INVENTION

According to the invention, this object is achieved by providing a method and an apparatus for casting under high pressure, in which the mold is evacuated for 5 to 20 seconds before the molten metal is poured into it, thereby providing a good and reliable separation of the gases from the molten metal, which is maintained under the action of the reduced pressure in the mold until the latter is totally filled. The separation of the gases from the molten metal is ensured particularly by providing the crucible with the molten metal during the evacuation in a common chamber with the casting mold, so that the evacuation is perfect and effective. After evacuating the air up to an optimal value, the crucible with the molten metal is tilted with its mouth downwards and then, after the mold has been filled up, being the whole time together with the molten metal under the action of vacuum, air or other gas under high pressure (e.g. 20 to 250 Kgf/cm$^2$) is introduced into the mold to act on the molten metal compressing it during the solidification process.

The apparatus to effect the method of the present invention comprises basically a chamber, in which there are disposed the casting mold, as well as the crucible with the molten metal. A tight closing of this chamber with the molten metal and the mold is provided to ensure reliable evacuation and the production of the high pressure.

BRIEF DESCRIPTION OF THE DRAWING

For a better understanding of the method and apparatus of the present invention, reference should be made to the accompanying drawing in which there is illustrated a preferred embodiment of the invention. The sole FIGURE of the drawing shows a vertical cross-sectional view of an apparatus according to the invention.

SPECIFIC DESCRIPTION

The crucible, which has been previously filled with molten metal, is disposed and fastened so as to make it possible to tilt its mouth downwards for pouring the molten metal into the mold, which is disposed in the space underneath. The chamber is tightly sealed and then it is evacuated. The crucible is tilted, the molten metal flows out vertically downwards into the mold and after the filling up of the latter, a high pressure is produced over the solidifying melt. During the action of the high pressure, which is preferably 20 to 150 kgf/cm$^2$ depending on the type of the casting (and most advantageously is 120 kgf/cm$^2$), the chamber is closed by a hydraulic closing device. After the necessary time for the action of the high pressure has elapsed, this pressure is relieved; thus the casting operation is terminated and the container with the mold is removed from the chamber.

The apparatus comprises two basic parts — the chamber 7 and the container 6. The chamber 7, in which the container 6 and the crucible 3 with the molten metal are disposed, is provided underneath with a movable hydraulic closing device, which is closed at the start of the evacuation of the chamber 7 and during the action of the high pressure.

The container 6 with the mold 2 and the crucible 3 with the molten metal is introduced into the chamber 7 from below, while the hydraulic device 9 and the straps 8 are open. The latter are attached laterally in the bottom part of the chamber 7.

The fastening of the straps 8 onto flanges in the bottom part of the chamber 7 and flanges of the hydraulic closing device, provides a tight closing of the latter.

The vacuum pump 12 and the compressor 11 are connected by pipe conduits with the chamber 7 through the cover of the latter and serve correspondingly for the evacuation of this chamber 7 and for producing the high pressure inside it.

The safety valve 4 in the cover of the chamber 7 operates upon exceeding a safe pressure of the air or gas during the solidification of the melt (to vent the chamber). Provided on the pipe conduits connecting the vacuum pump 12 and the compressor 11 are a vent or pressure-relief valve 5 and a reversing valve 10.

The apparatus of the present invention operates as follows:

The mold 2 (the number of molds can be greater than one) is placed in the container 6 with the crucible 3 disposed on it.

This set is introduced into the chamber 7 from below while the bottom of chamber 7 is open. The chamber 7 then is closed hermetically by means of the hydraulic closing device 9 and evacuation of chamber 7 by the vacuum pump is started.

Then the crucible 3 with the molten metal is tilted by means represented at 3' and the molten metal is poured into the mold 2. The evacuation continues 5 to 20 seconds more depending on the wall thickness of the casting.

Immediately thereafter the high pressure is produced by the compressor 11, its value being 20 to 150 kgf/cm$^2$ depending on the type of the casting, until the poured melt has solidified.

The action of the high pressure is stopped by the valve 5, thus terminating the casting step, and the container 6 is removed from the chamber 7.

It is an advantage of the present invention that it provides castings of very high quality, also in the case of complex shaped parts, without any deformations and without any changes in the structure and the chemical composition of the melt.

It is another feature of the invention, that the castings obtained by the apparatus of the invention have strength properties improved by about 20 to 30%, and improved wear resistance and hardness throughout the whole section etc., without alloying with expensive metals.

The invention provides a considerable increase of the utilization of the molten metal up to 95% as a result of the elimination of feeding heads and risers.

The apparatus permits serial production, eliminating any dust formation and the development of harmful gases and high temperatures in the working space.

We claim:

1. A metal-casting apparatus, comprising:

an upright pressurizable housing open at its bottom;

an upright upwardly open container receivable in said housing;

a casting mold in a lower part of said container including a mold body having a multiplicity of casting cavities, a passage opening at the top of said mold body communicating with said cavities, and a funnel communicating with said passage;

said container including a pair of upright walls extending above said funnel;

a molten-metal receptacle having a mouth mounted in said container above said mold;

means mounting said receptacle in said container between said walls for tilting movement about a horizontal axis whereby said receptacle dispenses metal into said funnel from said mouth in a tilted position of said receptacle;

means for hermetically sealing the bottom of said housing upon the insertion of said container therein with said receptacle in an upright position; and means for evacuating and pressurizing said housing, said means for evacuating and pressurizing said housing includes a compressor, a vacuum pump, a conduit communicating with said housing and a valve selectively connecting said compressor and said pump with said conduit, said housing including a flanged cover and said conduit opening into said housing on said cover.

2. The apparatus defined in claim 1 wherein said sealing means includes a sealing body having a flange, said housing having a flange, and straps interconnecting said flanges.

3. The apparatus defined in claim 1, further comprising a safety valve on said cover for relieving excess pressure within said housing.

4. The apparatus defined in claim 3, further comprising a vent valve connected to said conduit.

5. The apparatus defined in claim 4 wherein said sealing means includes a sealing body having a flange, said housing having a flange, and straps interconnecting said flanges.

* * * * *